United States Patent [19]

Nakahara et al.

[11] Patent Number: 4,671,752

[45] Date of Patent: Jun. 9, 1987

[54] AIR-PULVERIZING APPARATUS FOR HIGH-TEMPERATURE MOLTEN SLAG

[75] Inventors: Takafumi Nakahara; Makoto Fujiwara, both of Takasago; Motoe Kondo, Kobe; Yoshiharu Miyawaki, Fukuyama; Masayuki Hanmyo, Fukuyama; Shinya Kinoshita, Fukuyama; Masao Matsui, Fukuyama; Konoshin Tamura, Fukayasu; Susumu Murata, Fukuyama, all of Japan

[73] Assignee: Mitsubishi Jukogyo Kabushiki Kaisha, Tokyo, Japan

[21] Appl. No.: 709,175

[22] Filed: Mar. 7, 1985

Related U.S. Application Data

[63] Continuation-in-part of Ser. No. 609,092, May 10, 1984, abandoned.

[30] Foreign Application Priority Data

May 10, 1983 [JP] Japan ..... 58-80066

[51] Int. Cl.[4] ..... B22F 9/08; B29B 9/00; B29C 67/00

[52] U.S. Cl. ..... 425/7; 65/19; 65/141; 266/87; 266/137

[58] Field of Search ..... 425/6, 7; 264/5, 12–14, 264/164, 140; 65/16, 19, 29, 141, 162; 266/87, 137, 83; 75/24; 65/164

[56] References Cited

U.S. PATENT DOCUMENTS

| | | | |
|---|---|---|---|
| 2,159,433 | 5/1939 | Ervin | 425/7 |
| 2,246,907 | 6/1941 | Webster | 266/87 |
| 2,724,859 | 11/1955 | Richardson | 425/7 |
| 3,023,454 | 3/1962 | Kuzell et al. | 425/7 |
| 3,150,947 | 9/1964 | Bland | 264/12 |
| 3,395,995 | 8/1968 | Burch | 65/141 |
| 4,011,070 | 3/1977 | Hynd | 65/29 |
| 4,035,116 | 7/1977 | O'Brien et al. | 425/6 |
| 4,359,434 | 11/1982 | Tiberg | 264/12 |
| 4,405,296 | 9/1983 | Stuck et al. | 425/6 |

FOREIGN PATENT DOCUMENTS

| | | | |
|---|---|---|---|
| 311142 | 7/1956 | Japan . | |
| 311325 | 7/1956 | Japan . | |
| 484683 | 2/1973 | Japan . | |
| 282372 | 4/1971 | U.S.S.R. | 425/7 |

*Primary Examiner*—Barry S. Richman
*Assistant Examiner*—Joye L. Woodard
*Attorney, Agent, or Firm*—Wenderoth, Lind & Ponack

[57] ABSTRACT

An apparatus for air-pulverizing high-temperature molten slag by blowing air at high speed through a nozzle into a flow of molten slag that is falling from an inclined container by the intermediary of a turndish. A heat detector is provided for detecting the quantity of heat in the flow of molten slag after being air-pulverized by the high speed air flow, and a feedback control device which is responsive to a detection signal issued from the detector is provided for calculating a desirable inclination angle of the container or the turndish and transmitting a control signal obtained as a result of the calculation to a controller for controlling the inclination of the container or turndish thereby stabilizing the air-pulverizing of the high-temperature molten slag.

3 Claims, 2 Drawing Figures

AIR-PULVERIZING APPARATUS FOR HIGH-TEMPERATURE MOLTEN SLAG

This is a continutation-in-part of Applicants' co-pending application Ser. No. 609,092, filed May 10, 1984, now abandoned.

BACKGROUND OF THE INVENTION

The present invention relates to improvements in an air-pulverizing apparatus for high-temperature molten slag (an apparatus for finely pulverizing high-temperature molten slag by means of a high speed air flow) discharged from a blast-furnace, a converter, an electric furnace, etc.

An apparatus for air-pulverizing high-temperature molten slag of the type that while the high-temperature molten slag stored in a container is made to fall by the intermediary of a turndish disposed below the container by inclining the container, the high-temperature molten slag is pulverized by directing a high speed air flow from an air nozzle to a flow of the high temperature molten slag, has been heretofore known and used. However, in such an apparatus, unless the quantity of heat possessed by the flow of the high-temperature molten slag, which is a function of the flow rate, temperature and specific heat of the molten slag, is matched with the flow rate of the high speed air flow, it was impossible to stably air-pulverize high-temperature molten slag into a desirable condition such as, for example, into particles of a desired particle shape.

OBJECT AND SUMMARY OF THE INVENTION

It is therefore one object of the present invention to provide an improved air-pulverizing apparatus for high-temperature molten slag in which the high-temperature molten slag can be stably pulverized into a desirable condition.

According to one feature of the present invention, there is provided an apparatus for air-pulverizing high-temperature molten slag, in which while the high-temperature molten slag is stored in a container and made to fall from the container by the intermediary of a turndish disposed below the container by inclining the container, the high-temperature molten slag is air-pulverized by directing a high speed air flow from an air nozzle to a flow of the falling high-temperature molten slag, and which comprises a detector for detecting the quantity of heat carried by the flow of the molten slag that has been air-pulverized by the high speed air flow, a detector which continuously detects the angle of inclination of the container, or turndish and a feedback control device, responsive to detection signals from the heat detector and angle detector, for calculating a desirable inclination angle of the container or the turndish and for transmitting a control signal obtained as a result of the calculation to a controller of the angle of inclination of the container or the turndish to control the angle of inclination thereof.

BRIEF DESCRIPTION OF THE DRAWINGS

The above-mentioned and other features and objects of the present invention will become more apparent by reference to the following description of preferred embodiments of the invention taken in conjunction with the accompanying drawings, in which.

DETAILED DESCRIPTION OF THE PREFERRED EMBODIMENTS

Figure 1:
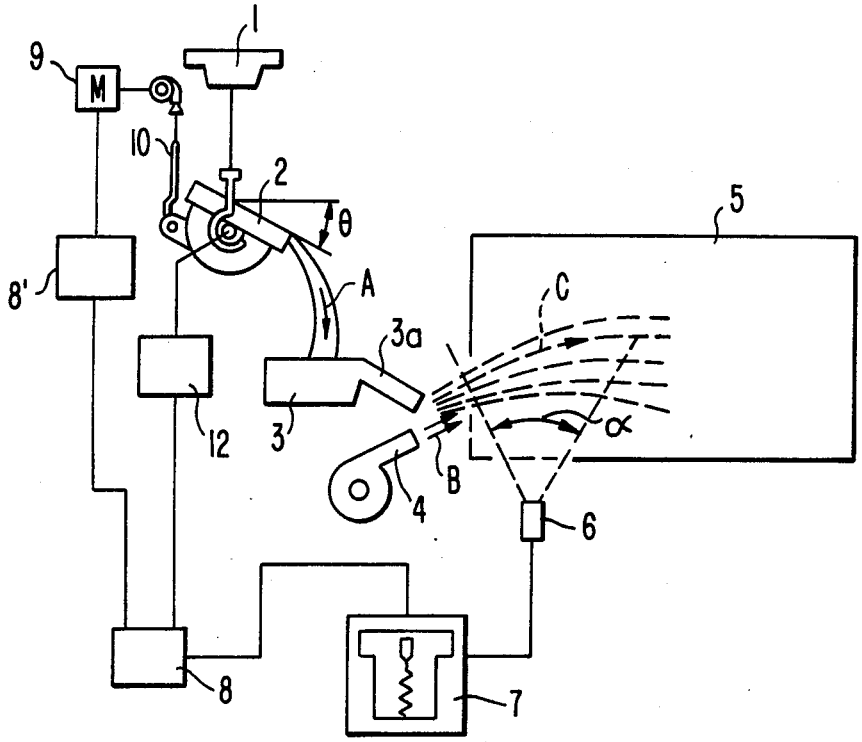
FIG. 1 is schematic side view showing one preferred embodiment of an air-pulverizing apparatus for high-temperature molten slag according to the present invention.

Now an air-pulverizing apparatus for high-temperature molten slag according to the present invention will be described by way of a first preferred embodiment thereof illustrated in FIG. 1. In this figure, reference numeral 1 designates a crane, numeral 2 designates a container for the high-temperature molten slag (slag pan) that is supported by being suspended from the crane 1, numeral 3 designates a turndish disposed below the container 2, numeral 3a designates a trough provided in the turndish 3, numeral 4 designates an air nozzle disposed below the trough 3a and numeral 5 designates a hood provided in front of the air nozzle 4. Numeral 6 designates a calorimeter such as a heat flux sensor (radiometer) manufactured by Hy Cal Engineering, disposed below the hood 5, numeral 7 designates an indicator for indicating a detected value transmitted from the calorimeter 6, numeral 8 designates a calculator (e.g. microcomputer) for calculating a desired inclination of the high-temperature molten slag container 2, numeral 8' designates a controller such as an eddy current controller, numeral 9 designates a variable speed electric motor which may be of the eddy current coupling type, numeral 12 designates a detector which detects the angle of inclination $\theta$ of the container 2, and numeral 10 designates an elevator member which is raised or lowered by the motor 9 to change the angle of inclination of the high-temperature molten slag container 2.

Next, description will be made of the operation of the air-pulverizing apparatus for high-temperature molten slag having the above-mentioned construction. The container 2 stores molten slag at a high temperature of about 1200°–1500° C. This container 2 is inclined to make the high-temperature molten slag stored in the container 2 fall into the turndish 3 (see arrow A), and further, the molten slag is discharged through the trough 3a of the turndish 3. At this time, pressurized air is concurrently ejected from the air nozzle 4, and the high-temperature molten slag discharged from the trough 3a is air-pulverized by a high speed flow of the pressurized air (see arrow C). Then, the calorimeter 6 disposed below the hood 5 detects the quantity of heat possessed by a group of air-pulverized molten slag particles which pass through the region of a sector having an angle $\alpha$ as shown in FIG. 1 (thereby to detect the rate of flow of heat through the sector of angle $\alpha$), and the produced detection value signal is transmittd via the indicator 7 to the calculator 8. The detector 12 continuously measures the actual inclination angle 8 of container 2 and transmits a signal indicative thereof to calculator 8. This calculator 8 calculates a desirable inclination angle of the container 2 on the basis of the desired slag flow rate, the angle of inclination of the container 2 detected by detector 12, and the detection value signal, and produces a control signal which is transmitted to the controller 8' for controlling the electric motor 9. The calculator 8 must of course be programmed to correlate to the detection value signal from the calorimeter to the actual slag flow rates according to know relations between the quantity of heat in a flow of slag and the flow rate, temperature and specific heat of the slag. The motor 9 is rotated according to the control signal to raise or lower the elevator member 10, and thereby the angle of inclination $\theta$ of the container 2 is regulated.

More particularly, the feedback control device consisting of the elements 8, 9, 10 and 12 achieves the control of the inclination angle $\theta$ in such a manner that if the quantity of heat possessed by a group of air-pulverized molten slag particles passing through the region of the sector having the angle $\alpha$ is too large, i.e., if the particle number (flow rate) is too large, then the angle of inclination $\theta$ of the container 2 may be decreased, whereas if that quantity of heat is too small, i.e., if the particle number (flow rate) is too small, then the angle of inclination $\theta$ of the container 2 may be increased. Thus, the control device maintains the flow rate of air-pulverized molten slag particles within a predetermined range or substantially constant. Since maintenance of a substantially constant flow of a liquid poured from a container generally requires continuously increasing the rate of tilting of the container (as is well known), the feedback means generally will have the effect of incrementally increasing or decreasing a preset rate of increase of the inclination angle $\theta$. This may be accomplished by modifying or incrementing the output of a tilting speed signal generator (incorporated in calculator 8), the output of which controls the controller 8'.

Accordingly, the air-pulverizing apparatus for high-temperature molten slag according to the present invention has the effect that high-temperature molten slag can be stably air-pulverized into a desirable condition.

Figure 2:
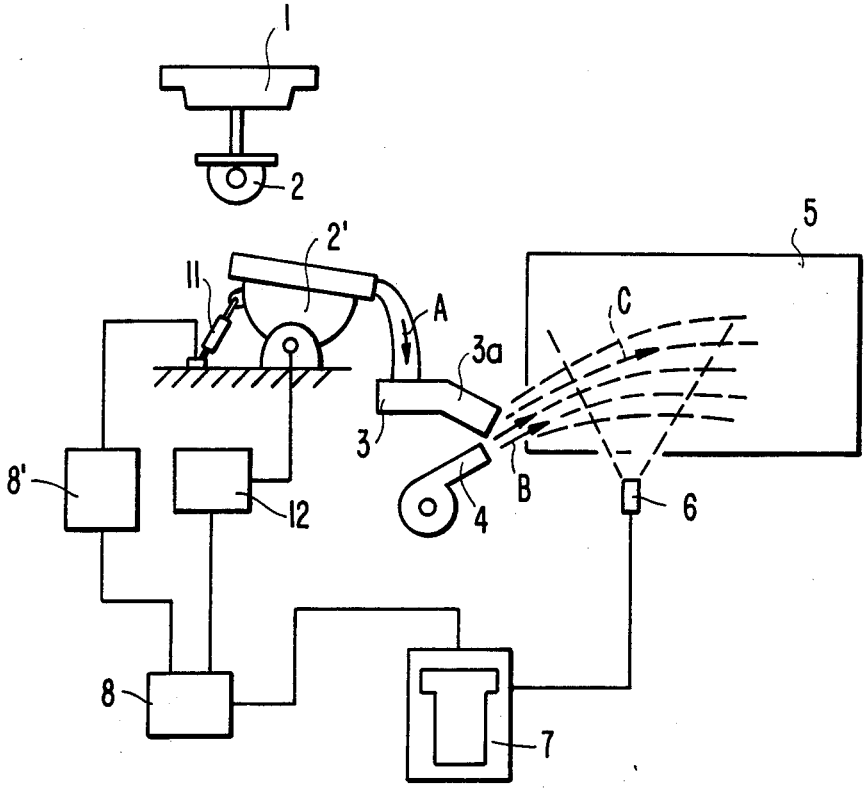
FIG. 2 is a schematic side view showing another preferred embodiment of the air-pulverizing apparatus according to the present invention.

FIG. 2 shows another preferred embodiment of the present invention, in which a separate container 2' for receiving high-temperature molten slag from the high-temperature molten slag container 2 as shown in FIG. 1, is mounted on a frame of the apparatus in a tiltable manner, and on the other hand, the hydraulic cylinder 11 for tilting the container 2' is provided in place of the means for inclining the container 2. With this modified embodiment also, the same effects and advantages as those obtained with the first preferred embodiment can be achieved. Still further, although illustration is omitted, the apparatus could be modified so as to provide a turndish 3 which is tiltable and the angle of inclination of the tiltable turndish 3 would be regulated by the control device.

While the present invention has been described above with reference to preferred embodiments of the invention, it is intended that the present invention should not be limited to the illustrated embodiments only, but various modifications and changes in design could be made without departing from the spirit of the present invention.

What is claimed is:

1. An apparatus for air-pulverizing high-temperature molten slag, comprising:

a container for containing a quantity of high-temperature molten slag;

a turndish below said container, said container being inclinable to pour the slag from said container into said turndish;

means for inclining said container so as to cause the slag to fall at high-temperature from said turndish;

means, having a nozzle, for blowing air at high speeds through said nozzle into the slag falling from said turndish so as to air-pulverize the slag and create a flow of air-pulverized slag;

means for detecting the quantity of heat in the flow of air-pulverized slag;

means for correlating the quantity of heat detected by said detecting means to the rate of flow of air-pulverized slag and producing a signal indicative of the quantity of heat, detected by said quantity of heat detecting means and the rate of flow of air-pulverized slag and feedback control means, responsive to said signal, for controlling said inclining means so as to control the rate of flow of slag from said turndish thereby to control the rate of flow of air-pulverized slag.

2. An apparatus as in claim 1, wherein said feedback control means comprises means for maintaining said rate of flow of air-pulverized slag within a predetermined range.

3. An apparatus as in claim 1, wherein said feedback control means comprises means for maintaining said rate of flow of air-pulverized slag substantially constant.

* * * * *